US007496325B2

(12) United States Patent
Sugimoto

(10) Patent No.: US 7,496,325 B2
(45) Date of Patent: Feb. 24, 2009

(54) CLEANING BLADE FOR USE IN IMAGE-FORMING APPARATUS

(75) Inventor: Mutsuki Sugimoto, Hyogo (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 67 days.

(21) Appl. No.: 11/637,154

(22) Filed: Dec. 12, 2006

(65) Prior Publication Data

US 2007/0140761 A1 Jun. 21, 2007

(30) Foreign Application Priority Data

Dec. 21, 2005 (JP) ..... 2005-368723

(51) Int. Cl.
*G03G 21/00* (2006.01)

(52) U.S. Cl. ..... 399/350; 525/940

(58) Field of Classification Search ..... 399/350, 399/343, 101, 99; 15/256.5, 256.51; 525/940
See application file for complete search history.

(56) References Cited

U.S. PATENT DOCUMENTS 5,903,808 A * 5/1999 Takizawa et al. ..... 399/286
2004/0266938 A1 12/2004 Tokumitsu et al.
2005/0163544 A1* 7/2005 Ito ..... 399/350
2005/0180790 A1* 8/2005 Mizumoto ..... 399/357
2005/0220502 A1* 10/2005 Kim ..... 399/286
2005/0254868 A1* 11/2005 Naruse et al. ..... 399/350
2007/0134035 A1* 6/2007 Kageyama ..... 399/350 X

FOREIGN PATENT DOCUMENTS

| | | | |
|---|---|---|---|
| EP | 1 586 958 | A2 | 10/2005 |
| GB | 2 181 944 | A | 5/1987 |
| JP | 2004-361844 | A | 12/2004 |
| JP | 2005-99340 | A | 4/2005 |

* cited by examiner

*Primary Examiner*—Sophia S Chen
(74) *Attorney, Agent, or Firm*—Birch, Stewart, Kolasch & Birch, LLP

(57) ABSTRACT

A cleaning blade, for use in an image-forming apparatus, which is formed by molding a thermosetting elastomer composition containing a rubber component consisting of acrylonitrile-butadiene rubber, natural rubber, butadiene rubber, styrene-butadiene rubber, isoprene rubber, butyl rubber, chloroprene rubber, acrylic rubber, epichlorohydrin rubber, ethylene propylene rubber, and ethylene-propylene-diene copolymer rubber or a mixture of two or more of the rubbers into a thin plate. An initial contact angle of the cleaning blade to the photoreceptor is set to 10° to 50°. A line pressure of the cleaning blade to be applied to the photoreceptor is set to 0.1 N/cm to 1.5 N/cm.

4 Claims, 2 Drawing Sheets

CLEANING BLADE FOR USE IN IMAGE-FORMING APPARATUS

This nonprovisional application claims priority under 35 U.S.C. § 119(a) on Patent Application No(s). 2005-368723 filed in Japan on Dec. 21, 2005, the entire contents of which are hereby incorporated by reference.

FIELD OF THE INVENTION

The present invention relates to a cleaning blade for use in an image-forming apparatus and more particularly to a cleaning blade which has a greatly improved performance in cleaning spherical polymerized toner having a small diameter.

In an electrostatic photocopying machine in which ordinary paper is used as recording paper, a copying operation is performed as follows: an electrostatic charge is applied to the surface of a photoreceptor by discharge, an image is exposed to the photoreceptor to form an electrostatic latent image thereon, toner having an opposite polarity is attached to the electrostatic latent image to develop the electrostatic latent image, a toner image is transferred to recording paper, and the recording paper to which the toner image has been transferred is heated under pressure to fix the toner to the recording paper. Therefore to sequentially copy the image of an original document on a plurality of sheets of recording paper, it is necessary to remove the toner which has remained on the surface of the photoreceptor after the toner image is transferred to the recording paper from the photoreceptor in the above-described processes. As a method of removing the toner, a cleaning method of sliding a cleaning blade in contact with the surface of the photoreceptor, with the cleaning blade being pressed against the surface of the photoreceptor is known.

The conventional cleaning blade for use in the image-forming apparatus used in the above-described method is composed of polyurethane rubber. Normally the initial contact angle of the cleaning blade to the photoreceptor is set to 15° to 25°, and the line pressure of the cleaning blade to be applied to the photoreceptor is set to 0.15 N/cm to 0.4 N/cm to clean pulverized toner or deformed polymerized toner on the photoreceptor. The cleaning blade composed of the urethane rubber is capable of cleaning the conventional pulverized toner or the deformed polymerized toner, even though the pressure of the cleaning blade (hereinafter often referred to as line pressure) at the contact portion between the cleaning blade and the photoreceptor is low.

The present tendency is to save energy, reduce the cost of the image-forming apparatus, and form a high-quality image. That being the case, the use of spherical polymerized toner having a small diameter is demanded. Unless the line pressure of the cleaning blade is increased, it is difficult to remove small-diameter spherical polymerized toner that has remained on the surface of the photoreceptor. Thereby the toner is apt to be cleaned faultily. When the pressure of the cleaning blade at the contact portion between the cleaning blade composed of the polyurethane rubber and the photoreceptor is increased, the frictional force becomes large. Thereby the edge of the cleaning blade wears excessively, a noise-making phenomenon occurs owing to vibrations caused by sliding contact between the cleaning blade and the photoreceptor, and a reversal phenomenon that the edge of the cleaning blade is moved in the rotational direction of the photoreceptor occurs. Thus it is difficult to increase the line pressure in the case of the cleaning blade composed of the polyurethane rubber.

To solve the above-described problem, the cleaning blade consisting of the polyurethane rubber intended to favorably clean the spherical toner is proposed and disclosed in Japanese Patent Application Laid-Open No. 2004-361844 (patent document 1). The urethane resin at the edge of the cleaning blade has a high hardness of not less than 90 degrees in JIS-A hardness. According to the disclosure made in the patent document 1, the cleaning blade is allowed to have a low coefficient of friction not more than 0.5. But in the cleaning method carried out by using the cleaning blade, it is necessary to clean not only toner on the surface of the photoreceptor, but also paper powder, a foreign matter, and a carrier all together. Thus, considering that the cleaning blade is pressed against the photoreceptor in performing a cleaning operation, there is a fear that the surface of the photoreceptor is damaged by the cleaning blade because it has a low degree of elastic deformation and a high hardness not less than 90 degrees in JIS-A hardness. In the cleaning blade of the patent document 1, the metal spring member is bonded to the cleaning blade to allow the cleaning blade to be elastic. Thus the process of bonding the metal spring member to the polyurethane rubber is required. Consequently the number of processes increases and the cost of manufacturing the cleaning blade increases. In addition, it is necessary to accurately bond the metal spring member to the polyurethane rubber. Thus the cleaning blade has problems in productivity.

Disclosed in Japanese Patent Application Laid-Open No. 2005-99340 (patent document 2) is the image-forming apparatus which is constructed to suppress the generation of the noise-making phenomenon and a reversal phenomenon and prevent the spherical polymerized toner having a small diameter from being defectively cleaned. In the image-forming apparatus, the ratio of the free length b (mm) from the tip of the supporting holder to the tip of the cleaning blade to the thickness a (mm) of the cleaning blade is set to fall in the range of $2.9LS/1000+3.7<b/a<3.1LS/1000+3.9$ in which LS indicates the line speed LS (mm/second) of the photoreceptor.

In the disclosure made in the patent document 2, it is preferable to set the initial contact angle of the cleaning blade to 7° to 20°. The present applicant conducted a test of examining the performance of the cleaning blade made of the polyurethane rubber in the above-described condition. As a result, the cleaning blade did not have preferable cleaning performance.

In the disclosure made in the patent document 2, the mounting of the cleaning roller upstream from the cleaning blade is proposed. To reliably clean the toner with the cleaning blade of the patent document 2, it is necessary to provide the image-forming apparatus with the auxiliary cleaning means.

Patent Document 1: Japanese Patent Application Laid-Open No. 2004-361844

Patent Document 2: Japanese Patent Application Laid-Open No. 2005-99340

SUMMARY OF THE INVENTION

The present invention has been made in view of the above-described problems. Therefore it is an object of the present invention to provide a cleaning blade which has a greatly improved performance in cleaning spherical polymerized toner having a small diameter and is restrained from making a noise and presenting a reversal phenomenon at a cleaning time.

To solve the above-described problems, the present invention provides a cleaning blade, for cleaning toner on a surface of a photoreceptor of an image-forming apparatus, which is formed by molding a thermosetting elastomer composition containing a rubber component (1) consisting of acrylonitrile-butadiene rubber, natural rubber, butadiene rubber, styrene-butadiene rubber, isoprene rubber, butyl rubber, chloroprene rubber, acrylic rubber, epichlorohydrin rubber, ethylene propylene rubber, and ethylene-propylene-diene copolymer rubber or a mixture of two or more of the rubbers into a thin plate.

An initial contact angle of the cleaning blade to the photoreceptor is set to 10° to 50°. A line pressure of the cleaning blade to be applied to the photoreceptor is set to 0.1 N/cm to 1.5 N/cm.

The cleaning blade of the present invention for use in the image-forming apparatus has the shape of a thin plate having rectangular upper and lower surfaces and thickness surfaces orthogonal to the upper and lower surfaces. Toner which has remained on the surface of a photoreceptor is cleaned by edges of the cleaning blade formed between the thickness surfaces thereof and the upper as well as lower surfaces thereof.

As described above, it is possible to decrease the coefficient of friction of the cleaning blade by composing the cleaning blade of the present invention for use in the image-forming apparatus of the thermosetting elastomer composition containing the rubber component (1) consisting of acrylonitrile-butadiene rubber, natural rubber, butadiene rubber, styrene-butadiene rubber, isoprene rubber, butyl rubber, chloroprene rubber, acrylic rubber, epichlorohydrin rubber, ethylene propylene rubber, and ethylene-propylene-diene copolymer rubber or the mixture of two or more of the rubbers into a thin plate. Thereby the cleaning blade is allowed to have a large line pressure to be applied to the photoreceptor and further have a greatly improved performance in cleaning the spherical polymerized toner having a small diameter. Further the cleaning blade is restrained from making a noise and presenting a reversal phenomenon at a cleaning time.

As the acrylonitrile-butadiene rubber (NBR), it is possible to use acrylonitrile-butadiene rubber having a carbonyl group introduced thereinto and hydrogenated acrylonitrile-butadiene rubber (HNBR).

As the rubber component, one kind of the above-described rubbers or not less than two kinds thereof may be used. When two kinds of the rubbers are used as the rubber component, the mixing amount of one (rubber a) of the two rubbers is favorably 90 parts by mass to 50 parts by mass and more favorably 90 parts by mass to 70 parts by mass, and the mixing amount of the other (rubber b) per 100 parts by mass of the rubber component (1) is favorably 10 parts by mass to 50 parts by mass and more favorably 10 parts by mass to 30 parts by mass, supposing that the total of the masses of the rubber components is 100 parts by mass.

As described above, the cleaning blade of the present invention for use in the image-forming apparatus is composed of the thermosetting elastomer composition. In addition, the initial contact angle of the cleaning blade to the photoreceptor of the image-forming apparatus is set to 10° to 50°. Further the line pressure of the cleaning blade to be applied to the photoreceptor is set to 0.1 N/cm to 1.5 N/cm.

The initial contact angle means the angle between the cleaning blade and the surface of the photoreceptor at the position where the edge of the cleaning blade contacts the surface of the photoreceptor in starting a cleaning operation.

The line pressure means the pressure of the cleaning blade applied to the photoreceptor per unit length of the edge of the cleaning blade.

The reason the initial contact angle of the cleaning blade to the photoreceptor is set to 10° to 50° is as follows: When the initial contact angle is less than 10°, an appropriate line pressure for cleaning the photoreceptor is not applied thereto and thus the photoreceptor is cleaned defectively. On the other hand, when the initial contact angle is more than 50°, the line pressure is so large that the noise-making phenomenon and the reversal phenomenon are generated by a large frictional force generated between the cleaning blade and the photoreceptor.

The initial contact angle of the cleaning blade to the photoreceptor is set to favorably 20° to 40°, and more favorably 20° to 30°.

The reason the line pressure of the cleaning blade to be applied to the photoreceptor is set to 0.1 N/cm to 1.5 N/cm is as follows: When the line pressure of the cleaning blade to be applied to the photoreceptor is less than 0.1 N/cm, an appropriate line pressure for cleaning the photoreceptor is not applied thereto and thus the photoreceptor is defectively cleaned. On the other hand, when the line pressure of the cleaning blade to be applied to the photoreceptor is more than 1.5 N/cm, a large frictional force is generated between the cleaning blade and the photoreceptor. As a result, the noise-making phenomenon and the reversal phenomenon are generated.

The line pressure of the cleaning blade to be applied to the photoreceptor is set to more favorably 0.2 N/cm to 1.4 N/cm and most favorably 0.5 N/cm to 1.4 N/cm.

The thermosetting elastomer composition to be molded into the cleaning blade essentially contains the above-described rubber component (1), a filler (2), and a crosslinking agent (3). It is preferable that the thermosetting elastomer composition contains 0.1 parts by mass to 80 parts by mass of the filler (2) and 0.1 parts by mass to 30 parts by mass of the crosslinking agent (3) per 100 parts by mass of the rubber component (1).

The reason the mixing amount of the filler (2) is set to favorably 0.1 parts by mass to 80 parts by mass per 100 parts by mass of the rubber component (1) is as follows: When the mixing amount of the filler (2) is set to smaller than 0.1 parts by mass, there is a fear that the rubber component is not sufficiently reinforced nor vulcanized. On the other hand, when the mixing amount of the filler (2) exceeds 80 parts by mass, there is a fear that the thermosetting elastomer composition has a very high hardness and that the cleaning blade composed of the thermosetting elastomer composition damages the photoreceptor.

The mixing amount of the crosslinking agent (3) is set to 0.1 parts by mass to 30 parts by mass for the following reason: When the mixing amount of the crosslinking agent (3) is smaller than 0.1 parts by mass, the vulcanizing density becomes small and there is a fear that the thermosetting elastomer composition is not provided with a desired property. On the other hand, when the mixing amount of the crosslinking agent (3) exceeds 30 parts by mass, an excessive crosslinking reaction takes place. As a result, the hardness of the thermosetting elastomer composition is so high that there is a fear the cleaning blade of the present invention may damage the photoreceptor.

It is preferable to use the acrylonitrile-butadiene rubber (NBR) or the hydrogenated acrylonitrile-butadiene rubber (HNBR) as the rubber component (1). It is especially preferable to use the hydrogenated acrylonitrile-butadiene rubber (HNBR) having residual double bonds at smaller than 10%.

As the NBR or the NBR which is used as the material of the HNBR, it is possible to use any of low-nitrile NBR having the bound acrylonitrile amount of less than 25%, intermediate-nitrile NBR having the bound acrylonitrile amount of 25% to 31%, moderate high-nitrile NBR having the bound acrylonitrile amount of 31% to 36%, high-nitrile NBR having the bound acrylonitrile amount of not less than 36%. It is preferable to use the moderate high-nitrile NBR having the bound acrylonitrile amount of 31% to 36%.

As desired, the other rubber (rubber b) may be combined with the acrylonitrile-butadiene rubber or with the hydrogenated acrylonitrile-butadiene rubber (rubber a). As the other rubber (rubber b), any of the above-exemplified rubbers can be used. When the other rubber (rubber b) is combined with the acrylonitrile-butadiene rubber or with the hydrogenated acrylonitrile-butadiene rubber (rubber a), the mixing amount of the rubber a with respect to the sum of the rubber component (1), namely, 100 parts by mass is 90 parts by mass to 50 parts by mass and favorably 90 parts by mass to 70 parts by mass, and the mixing amount of the rubber b per 100 parts by mass of the rubber component (1) is 10 parts by mass to 50 parts by mass and favorably 10 parts by mass to 30 parts by mass.

It is preferable that as the filler (2) used for the thermosetting elastomer composition constructing the cleaning blade of the present invention includes a co-crosslinking agent, a vulcanization accelerator, a vulcanization-accelerating assistant, an age resistor, a softener for rubber, a reinforcing agent, and other kinds of additives. These fillers (2) may be used singly or by mixing two or more of them with each other.

The co-crosslinking agent crosslinks itself and reacts with rubber molecules to crosslink them, thus making the entire elastomer composition polymeric.

As the co-crosslinking agent, it is possible to use ethylene unsaturated monomers represented by methacrylate ester and metal salts of methacrylic acid or acrylic acid; polyfunctional polymers; and dioximes.

As the ethylene unsaturated monomer, the following substances are listed:

(a) Monocarboxylic acids such as acrylic acid, methacrylic acid, crotonic acid, and the like.

(b) Dicarboxylic acids such as maleic acid, fumaric acid, itaconic acid, and the like.

(c) Ester or anhydride of the above-described (a) and (b)

(d) Metal salts of the above-described (a) through (c)

(e) Aliphatic conjugated dienes such as 1,3-butadiene, isoprene, 2-chloro-1,3-butadiene, and the like (f) Aromatic vinyl compounds such as styrene, α-methylstyrene, vinyltoluene, ethyl vinylbenzene, divinylbenzene, and the like (g) Vinyl compounds having a heterocyclic ring such as triallyl isocyanurate, triallyl cyanurate, and vinylpyridine (h) Vinyl cyanide compounds such as methacrylonitrile and α-chloroacrylonitrile, acrolein, formylstyrol, vinyl methyl ketone, vinyl ethyl ketone, and vinyl butyl ketone.

As the ester of the monocarboxylic acids, the following substances are listed:

alkyl esters of methacrylic acid such as methyl methacrylate, ethyl methacrylate, n-propyl methacrylate, i-propyl methacrylate, n-butyl methacrylate, i-butyl methacrylate, n-pentyl methacrylate, i-pentyl methacrylate, n-hexyl methacrylate, cyclohexyl methacrylate, 2-ethylhexyl methacrylate, octyl methacrylate, i-nonyl methacrylate, tert-butyl cyclohexyl methacrylate, decyl methacrylate, dodecyl methacrylate, hydroxymethyl methacrylate; hydroxyethyl methacrylate amino alkyl esters of methacrylic acid such as aminoethyl acrylate, dimethylaminoethyl acrylate, butylaminoethyl acrylate, and the like;

methacrylate having an aromatic ring such as benzyl methacrylate, benzoyl methacrylate, allyl methacrylate, and the like;

methacrylate having an epoxy group such as glycidyl methacrylate, methaglycidyl methacrylate, epoxycyclohexyl methacrylate, and the like; and methacrylate having functional groups such as N-methylolmethacrylamide, γ-methacryloxypropyltrimethoxysilane; and methacrylate having a polyfunctional group such as ethylene glycol dimethacrylate, trimethylolpropane trimethacrylate, and the like.

As the "esters of dicarboxylic acids" of the above-described (c), half esters such as methyl maleate, methyl itaconate; diallyl phthalate, diallyl itaconate, and the like are listed.

As the "anhydrides of the unsaturated carboxylic acids" of the above-described (c), anhydride of acrylic acid, anhydride of maleic acid, and the like are listed.

As the "metal salts" of the above-described (d), aluminum salts, calcium salts, zinc salts, and magnesium salts of unsaturated carboxylic acids such as acrylic acid, methacrylic acid, maleic acid, and fumaric acid are listed.

As the ethylene unsaturated monomer that can be preferably used as the co-crosslinking agent in the present invention, the following substances are listed:

methacrylic acid;

higher ester of methacrylic acid such as trimethylolpropane trimethacrylate (TMPT), ethylene dimethacrylate (EDMA), polyethylene glycol dimethacrylate, cyclohexyl methacrylate, allyl methacrylate, tetrahydrofurfuryl methacrylate, and isobutylene ethylene dimethacrylate;

metal salts of methacrylic acid or acrylic acid such as aluminum acrylate, aluminum methacrylate, zinc acrylate, zinc methacrylate, calcium acrylate, calcium methacrylate, magnesium acrylate, magnesium methacrylate, and the like; and triallyl isocyanurate, triallyl cyanurate, diallyl phthalate, diallyl itaconate, vinyl toluene, vinyl pyridine, and divinylbenzene.

As the polyfunctional polymers, those utilizing the functional group of 1,2-polybutadiene are listed. More specifically, Buton 150, Buton 100, polybutadiene R-15, Diene-35, Hystal-B2000, and the like are listed.

As the above-described dioximes, p-quinonedioxime, p,p'-dibenzoyl quinonedioxime, N,N'-m-phenylenebismaleimide, and the like are listed.

The mixing amount of the co-crosslinking agent should be large enough to allow the rubber component to be vulcanized. Normally, the mixing amount of the co-crosslinking agent per 100 parts by mass of the rubber component is selected in the range of 0.1 to 10 parts by mass.

As the vulcanization accelerator, both inorganic accelerators and organic accelerators can be used.

As the inorganic accelerator, it is possible to use slaked lime, magnesium oxide, titanium oxide, and litharge (PbO).

As the organic accelerator, thiurams, thiazoles, thioureas, dithiocarbamates, guanidines, and sulfeneamides are listed.

As the thiurams, tetramethylthiuram monosulfide, tetramethylthiuram disulfide, tetraethylthiuram disulfide, tetrabutylthiuram disulfide, and dipentamethylenethiuram tetrasulfide are listed.

As the thiazoles, it is possible to list 2-mercaptobenzothiazole, dibenzothiazyl disulfide, N-cyclohexyl benzothiazole, N-cyclohexyl-2-benzothiazolylsulfeneamide, N-oxydiethylene-2-benzothiazolylsulfeneamide, N-tert-butyl-2-benzothiazolylsulfeneamide, and N,N-dicyclohexyl-2-benzothiazolylsulfeneamide.

As the thioureas, N,N'-diethylthiourea, ethylenethiourea, and trimethylthiourea are listed.

As the salts of the dithiocarbamates, zinc dimethyl dithiocarbamate, zinc diethyl dithiocarbamate, zinc dibutyl dithiocarbamate, sodium dimethyl dithiocarbamate, sodium diethyl dithiocarbamate, copper dimethyl dithiocarbamate, ferric dimethyl dithiocarbamate (III), selenium diethyl dithiocarbamate, and tellurium diethyl dithiocarbamate are listed.

As the guanidine accelerator, it is possible to list di-o-tolyl guanidine, 1,3-diphenyl guanidine, 1-o-tolylbiguanide, and di-o-tolylbiguanide salts of dicatechol borate.

As the sulfeneamides, N-cyclohexyl-2-benzothiazolyl sulfeneamide and the like are listed.

The mixing amount of the vulcanization accelerator should be large enough to allow the property of the rubber component to be displayed. The mixing amount of the vulcanization accelerator is selected in the range of 0.5 to 3 parts by mass per 100 parts by mass of the rubber component.

The vulcanization-accelerating assistant that is used in the present invention includes metal oxides such as zinc white; fatty acids such as stearic acid, oleic acid, cotton seed fatty acid; and known vulcanization-accelerating assistants. The metal oxides such as zinc white also serve as reinforcing agents described below. As the plasticizer, compounds of phthalic acid, adipic acid, sebacic acid, benzoic acid, and the like. More specifically, dibutyl phthalate (DBP), dioctyl phthalate (DOP), tricresyl phosphate (TCP), and the like are listed.

The mixing amount of the vulcanization-accelerating assistant should be large enough to allow the property of the rubber component to be displayed. Normally, the mixing amount of the vulcanization-accelerating assistant is selected in the range of 0.5 to 5 parts by mass per 100 parts by mass of the rubber component.

As the age resistor, amines, imidazoles, and phenols are listed.

As the amines, styrenated diphenylamine, dialkyldiphenylamine, phenyl-α-naphthylamine, N,N'-diphenyl-p-phenylenediamine, N-phenyl-N'-isopropyl-p-phenylenediamine, N,N'-di-2-naphthyl-p-phenylenediamine, and N,N'-di-6-naphthyl-p-phenylenediamine are listed.

As the imidazoles, 2-mercaptobenzimidazole, zinc salts of 2-mercaptobenzimidazole, and 2-mercaptomethylbenzimidazole are listed.

As the phenols, 2,5-di-tert-butyl hydroquinone; 2,5-di-tert-amyl hydroquinone, 2,2'-methylene bis(4-methyl-6-tert-butyl phenol); 2,2'-methylene bis(4-ethyl-6-tert-butyl phenol); 2,6-di-tert-butyl-4-methyl phenol; 4,4'-thiobis(6-tert-butyl-3-methylphenol); styrenated methyl phenol; 4,4'-butylidene bis(3-methyl-6-tert-butyl phenol); mono-(α-methylbenzyl)phenol, di(α-methylbenzyl)phenol, tri(α-methylbenzyl)phenol, and 1,1-bis(4-hidroxyphenyl) cyclohexane.

In addition, as the age resistor, it is possible to use poly(2,2,4-trimethyl-1,2-dihydroquinoline), 6-ethoxy-1,2-dihydro-2,2,4-trimethylquinoline, 1-(N-phenylamino)-naphthalene, nickel dibutyldithiocarbamate, tris(nonyl phenyl)phosphite, dilauryl thiodipropionate, and distearyl thiodipropionate.

The mixing amount of the age resistor should be large enough to allow the property of the rubber component to be displayed. Normally the mixing amount of the agent resistor is selected in the range of 1 to 10 parts by mass per 100 parts by mass of the rubber component.

As the softener for rubber, it is possible to use derivatives of phthalic acid, isophthalic acid, adipic acid, sebacic acid, benzoic acid, and phosphoric acid.

More specifically, it is possible to list dioctyl phthalate (DOP) such as dibutyl phthalate (DBP) and di-(2-ethylhexyl) phthalate; di-iso-octyl phthalate (DIOP), higher alcohol phthalate, di-(2-ethylhexyl) sebacate, polyester adipate, dibutyl diglycol adipate, di(butoxyethoxyethyl) adipate, iso-octyl-tall oil fatty ester, tributyl phosphate (TBP), tributoxyethyl phosphate (TBEP), tricresyl phosphate (TCP), cresyl diphenyl phosphate (CDP), and diphenyl alkane.

The mixing amount of the softener for rubber should be large enough to allow the property of the rubber component to be displayed. Normally the mixing amount of the softener is selected in the range of 0.5 to 5 parts by mass per 100 parts by mass of the rubber component.

As the reinforcing agent, in addition to carbon black mainly used as a filler for guiding an interaction of the carbon black with the elastomer, it is possible to use inorganic reinforcing agents such as white carbon (silica filler such as dry silica or wet silica, silicate such as magnesium silicate), calcium carbonate, magnesium carbonate, magnesium silicate, clay (aluminum silicate), silane-modified clay, and talc; and organic reinforcing agents such as coumarone and indene resin, phenol resin, high styrene resin, and wood meal.

As the carbon black excellent in its reinforcing effect, low in cost, high dispersibility, and high wear resistance, it is preferable to use SAF carbon (average particle diameter: 18 to 22 nm), SAF-HS carbon (average particle diameter: about 20 nm), ISAF carbon (average particle diameter: 19 to 29 nm), N-339 carbon (average particle diameter: about 24 nm), ISAF-LS carbon (average particle diameter: 21 to 24 nm), I-ISAF-HS carbon (average particle diameter: 21 to 31 nm), HAF carbon (average particle diameter: about 26 to 30 nm), HAF-HS carbon (average particle diameter: 22 to 30 nm), N-351 carbon (average particle diameter: about 29 nm), HAF-LS carbon (average particle diameter: about 25 to 29 nm), LI-HAF carbon (average particle diameter: about 29 nm), MAF carbon (average particle diameter: 30 to 35 nm), FEF carbon (average particle diameter: about 40 to 52 nm), SRF carbon (average particle diameter: 58 to 94 nm), SRF-LM carbon, and GPF carbon (average particle diameter: 49 to 84 nm) are listed. Above all, the FEF carbon, the ISAF carbon, the SAF carbon, and the HAF carbon are preferable.

The mixing amount of the reinforcing agent should be large enough to allow the property of the rubber component to be displayed. Normally the mixing amount of the reinforcing agent is selected in the range of 5 to 100 parts by mass per 100 parts by mass of the rubber component.

As other additives, amide compounds, metal salts of fatty acids, and wax are listed.

As the amide compounds, aliphatic amide compounds and aromatic amide compounds are listed. As fatty acids of the aliphatic amide compounds, oleic acid, stearic acid, erucic acid, caproic acid, caprilic acid, lauryl acid, myristic acid, palmitic acid, arachidic acid, behenic acid, palmitoleic acid, eicosane acid, erucic acid, elaidic acid, trans-11-eicosane acid, trans-13-docosane acid, linolic acid, linolenic acid, and ricinoleic acid are listed. As the aliphatic amide compounds, it is preferable to use ethylene-bis-erucic acid amide, ethylene-bis-oleic acid amide, ethylene-bis-stearic acid amide, oleic acid amide, stearic acid amide, erucic acid amide, and behenic acid amide. The oleic acid amide, the stearic acid amide, and the erucic acid amide are especially preferable.

To form the metal salts of the fatty acids, the fatty acids are selected from among lauryl acid, stearic acid, palmitic acid, myristic acid, and oleic acid are listed. The metals are selected from among zinc, iron, calcium, aluminum, lithium, magnesium, strontium, barium, cerium, titanium, zirconium, lead, and manganese.

As the wax, paraffin wax, montan wax, amide wax are listed.

The mixing amount of these additives should be large enough to allow the property of the rubber component to be displayed. Normally the mixing amount of the additives per 100 parts by mass of the rubber component is selected in the range of 1 to 10 parts by mass as desired.

As the crosslinking agent (3) to be added to the thermosetting elastomer composition constituting the cleaning blade of the present invention, sulfur, an organic sulfur-containing compound, an organic peroxide, a heat-resistant crosslinking agent, and a resin crosslinking agent are listed.

The sulfur is used as fine powder formed by pulverizing recovered sulfur. Surface-treated sulfur having improved dispersibility can be appropriately used. Insoluble sulfur can be also used to prevent it from blooming from unvulcanized rubber.

As the organic sulfur-containing compounds, N,N'-dithiobismorpholine and the like are listed.

As the organic peroxides, it is possible to list benzoyl peroxide, 1,1-di-(tert-butyl peroxy)-3,3,5-trimethylcyclohexane, 2,5-dimethyl-2,5-di-(benzoyl peroxy)hexane, 2,5-dimethyl-2,5-di-(benzoyl peroxy)-3-hexene, 2,5-dimethyl-2,5-di-(tert-butyl peroxy)hexane, di-tert-butyl peroxy-di-isopropylbenzene, di-tert-butyl peroxide, di-tert-butylperoxybenzoate, dicumyl peroxide, tert-butyl cumyl peroxide, 2,5-dimethyl-2,5-di-(tert-butyl peroxy)-3-hexene, 1,3-bis(tert-butyl peroxyisopropyl)benzene, n-butyl-4,4-bis (tert-butyl peroxy)valerate, p-chlorobenzoyl peroxide, 2,4-dichlorobenzoyl peroxide, tert-butyl peroxyisopropyl carbonate, diacetyl peroxide, lauroyl peroxide.

As the heat-resistant crosslinking agent, 1,3-bis(citraconimide methyl)benzene, hexamethylene-1,6-sodium bisthiosulfate-dihydrate, and 1,6-bis(dibenzylthiocarbamoyl disulfide)hexane are listed.

As the resin crosslinking agent, alkylphenol resin or bromized alkylphenol formaldehyde resin such as Tackrol 201 (produced by Taoka Chemical Co.,Ltd.), Tackrol 250-III (produced by Taoka Chemical Co.,Ltd.), and Hitanol 2501 (produced by Hitachi Chemical Co.,Ltd.) are listed.

The mixing amount of the crosslinking agent should be large enough to allow the property of the rubber component to be displayed. Normally the mixing amount of the crosslinking agent per 100 parts by mass of the rubber component is selected in the range of 0.1 to 30 parts by mass.

The cleaning blade of the present invention composed of the thermosetting elastomer composition is obtained by mixing the above-described components with one another by using a rubber kneading apparatus such as a single-screw extruder, a 1.5-screw extruder, a twin screw extruder, an open roll, a kneader, a Banbury mixer or a heated roller.

The order of mixing the components is not specifically limited, but it is possible to supply the components to the kneading apparatus all together. It is also possible to supply a part of the components to the kneading apparatus, knead them to obtain a mixture, add remaining components to the mixture, and re-perform a kneading operation. It is preferable to carry out a method of kneading the rubber component (1) and the filler (2) to obtain a mixture, add the crosslinking agent (3) to the mixture, and thereafter re-performing a kneading operation.

The cleaning blade of the present invention for use in the image-forming apparatus is obtained by molding the thermosetting elastomer composition by using a known molding method such as compression molding or injection molding.

The cleaning blade of the present invention obtained in the above-described manner has the initial contact angle of 10° to 500 to the photoreceptor, and the line pressure of 0.1 N/cm to 1.5 N/cm. Thereby the cleaning blade is capable of cleaning small-diameter spherical polymerized toner having a volumetric mean diameter of 5 μm to 10 μm and a sphericity of 0.90 to 0.99. The cleaning blade is capable of cleaning the polymerized toner consisting of a polyester resin composition, a styrene-acrylic resin composition, and other resin compositions.

The effect of the present invention is described below. As described above, the cleaning blade of the present invention for use in an image-forming apparatus is formed by molding the thermosetting elastomer composition having a low coefficient of friction. Thereby the cleaning blade is capable of applying a large line pressure to the photoreceptor without greatly increasing the frictional force between the cleaning blade and the photoreceptor.

The initial contact angle of the cleaning blade to the photoreceptor is set to 10° to 50°. The line pressure of the cleaning blade to be applied to the photoreceptor is set to 0.1 N/cm to 1.5 N/cm. Thereby the cleaning blade is effectively restrained from generating the noise-making phenomenon and the reversal phenomenon at a cleaning time and allowed to have improved performance in cleaning the spherical polymerized toner having a small diameter.

DETAILED DESCRIPTION OF THE PREFERRED EMBODIMENTS

The embodiment of a cleaning blade of the present invention for use in an image-forming apparatus will be described in detail below with reference to the drawings.

Figure 1:
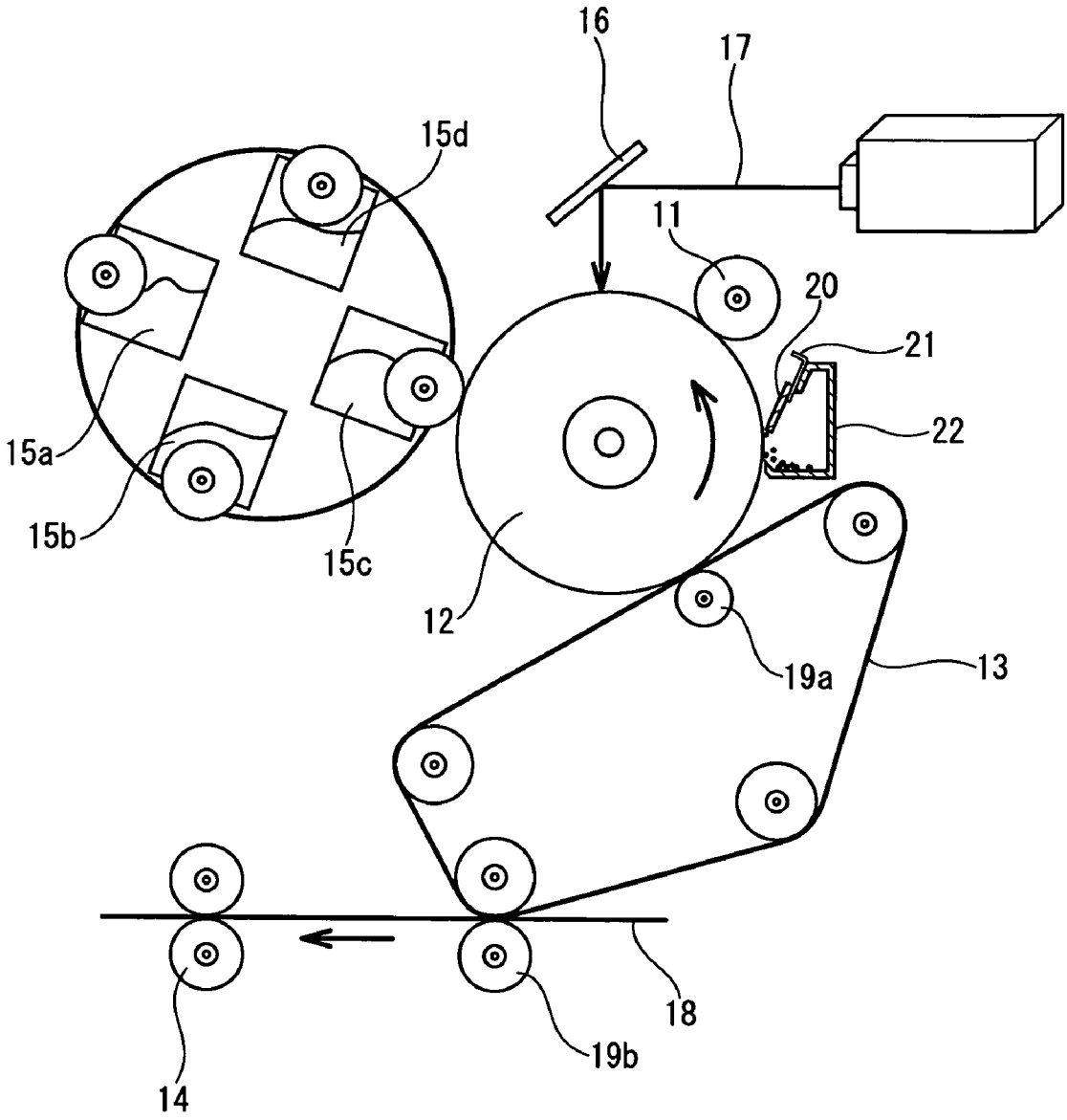
FIG. 1 is an illustrative view showing a color image-forming apparatus on which a cleaning blade of the present invention is mounted.

FIG. 1 shows a cleaning blade 20 of the present invention and an image-forming apparatus on which the cleaning blade 20 is mounted.

The cleaning blade 20 is bonded to a supporting member 21 with an adhesive agent. The supporting member 21 is composed of a rigid metal, an elastic metal, plastic or ceramic. It is favorable that the supporting member 21 is made of metal and more favorable that it is made of chrome free SECC.

As the adhesive agent for bonding the cleaning blade 20 and the supporting member 21 to each other, a polyamide or polyurethane hot-melt adhesive agent and an epoxy or phenol adhesive agent are used. It is preferable to use the hot-melt adhesive agent.

The color image-forming apparatus shown in FIG. 1 forms an image in processes described below:

Initially, a photoreceptor 12 rotates in the direction shown with the arrow of FIG. 1. After the photoreceptor 12 is charged by a charging roller 11, a laser 17 exposes a non-imaging portion of the photoreceptor 12 via a mirror 16, thus destaticizing the non-imaging portion. At this time, the portion of the photoreceptor 12 corresponding to an imaging portion is charged. Thereafter a toner 15*a* is supplied to the photoreceptor 12 and attaches to the charged imaging portion to form a first-color toner image. The toner image is transferred to an intermediate transfer belt 13 via a primary transfer roller 19*a*. In the same manner, a toner image of each of other color toners 15*b* to 15*d* formed on the photoreceptor 12 is transferred to the intermediate transfer belt 13. A full-color image composed of the four color toners 15*a* through 15*d* is formed on the intermediate transfer belt 13. The full-color image is transferred to a to-be-transferred material (normally, paper) 18 via a secondary transfer roller 19*b*. When the to-be-transferred material 18 passes between a pair of a fixing rollers 14 heated to a predetermined temperature, the full-color image is fixed to the surface thereof.

In the above-described processes, to sequentially copy the image of an original document on a plurality of recording paper, toner which has not been transferred to the intermediate transfer belt 13 but has remained on the photoreceptor 12 is removed from the surface of the photoreceptor 12 by rubbing the photoreceptor 12 with a cleaning blade 20 pressed against the surface of the photoreceptor 12 and is collected in a toner collection box 22.

The cleaning blade 20 of the present invention for use in the image-forming apparatus is formed by molding the above-described thermosetting elastomer composition containing essentially the rubber component (1), the filler (2*b*), and the crosslinking agent (3).

As the rubber component (1), the acrylonitrile-butadiene rubber (rubber a) or the hydrogenated acrylonitrile-butadiene rubber (rubber a) is used.

It is preferable to use moderate high-nitrile acrylonitrile-butadiene rubber having a bound acrylonitrile amount of 31% to 36% as the acrylonitrile-butadiene rubber.

As the hydrogenated acrylonitrile-butadiene rubber, it is preferable to hydrogenate the moderate high-nitrile acrylonitrile-butadiene rubber to allow the hydrogenated acrylonitrile-butadiene rubber to have a residual double bond of not more than 10%. It is most favorable to use the hydrogenated acrylonitrile-butadiene rubber having the residual double bond of not more than 10% as the rubber component (1).

The mixing amount of the filler (2) is set to 1 part by mass to 80 parts by mass, favorably 10 parts by mass to 80 parts by mass, and more favorably 20 parts by mass to 70 parts by mass per 100 parts by mass of the rubber component (1).

As the filler (2), a co-crosslinking agent, a vulcanization accelerator, a vulcanization-accelerating assistant, and a reinforcing agent are used. As the co-crosslinking agent, it is preferable to use methacrylic acid. The mixing amount of the methacrylic acid is set to 5 parts by mass to 10 parts by mass and favorably 7 parts by mass to 10 parts by mass per 100 parts by mass of the rubber component.

As the vulcanization accelerator, it is preferable to use magnesium oxide which is an inorganic accelerating agent and thiazoles or thiurams which are organic accelerating agents. As the thiazoles, dibenzothiazyl disulfide is most favorable. As the thiurams, tetramethylthiuram monosulfide is most favorable. The mixing amount of the magnesium oxide is set to 5 parts by mass to 10 parts by mass and preferably 7 parts by mass to 10 parts by mass per 100 parts by mass of the rubber component. The mixing amount of the thiazoles and the thiurams is set to 0.5 parts by mass to 3 parts by mass per 100 parts by mass of the rubber component.

It is preferable to use zinc oxide or stearic acid as the vulcanization-accelerating assistant. The mixing amount of the vulcanization-accelerating assistant is set to 1 to 10 parts by mass and favorably two to eight parts by mass per 100 parts by mass of the rubber component (1). When two or more kinds of the vulcanization-accelerating assistant are used in combination, the mixing amount of one kind of the vulcanization-accelerating assistant is preferably 0.5 to 5 parts by mass per 100 parts by mass of the rubber component (1).

It is favorable to use carbon black as the reinforcing agent and especially favorable to use ISAF carbon. The mixing amount of the carbon black is set to 10 parts by mass to 80 parts by mass and favorably 10 to 60 parts by mass per 100 parts by mass of the rubber component (1).

The above-described component serving as the filler (2) may be used singly or in combination of not less than two kinds thereof. Above all, it is preferable to use the co-crosslinking agent, the vulcanization accelerator, and the reinforcing agent in combination; the vulcanization accelerator, the vulcanization-accelerating assistant, and the reinforcing agent in combination; and the vulcanization accelerator and the reinforcing agent in combination. It is particularly preferable to use methacrylic acid, the magnesium oxide, and the carbon black in combination; the thiazoles and/or the thiurams, the zinc oxide, the stearic acid, and the carbon black in combination; and the zinc oxide, the stearic acid, and the carbon black in combination.

The mixing amount of the crosslinking agent (3) is set to 0.5 parts by mass to 30 parts by mass and preferably 1 part by mass to 20 parts by mass per 100 parts by mass of the rubber component (1).

As the crosslinking agent (3), sulfur, an organic peroxide or a resin crosslinking agent is used. These crosslinking agents may be used singly or in combination of not less than two kinds thereof.

As the sulfur, it is preferable to use powder sulfur. The mixing amount of the sulfur is set to 0.5 parts by mass to 5 parts by mass and favorably 1 part by mass to 3 parts by mass per 100 parts by mass of the rubber component (1). When the sulfur is used as the crosslinking agent (3), it is preferable to use the vulcanization accelerator and the vulcanization-accelerating assistant as the filler (2).

As the organic peroxide, it is preferable to use dicumyl peroxide. The mixing amount of the organic peroxide per 100 parts by mass of the rubber component is set to 0.5 parts by mass to 10 parts by mass and preferably 1 part by mass to 6 parts by mass.

As the resin crosslinking agent, it is preferable to use alkylphenol resin. The mixing amount of the resin crosslinking agent is set to 5 parts by mass to 20 parts by mass and preferably 10 parts by mass to 20 parts by mass per 100 parts by mass of the rubber component.

The thermosetting elastomer composition which is used in the present invention is produced as described below:

Initially the rubber component (1) and the filler (2) are kneaded at 80 to 120° C. for five to six minutes with the kneading apparatus such as the single-screw extruder, the 1.5-screw extruder, the twin screw extruder, the open roll, the kneader, the Banbury mixer, and the heated roller. If the kneading temperature is less than 80° C. and the kneading period of time is less than five minutes, the rubber component (1) is insufficiently plasticized and the mixture is insufficiently kneaded. If the kneading temperature is more than 120° C. and the kneading period of time is more than six minutes, there is a fear that the rubber component (1) is decomposed.

After the crosslinking agent (3) is added to the obtained mixture, they are kneaded at 80 to 90° C. for five to six minutes by using the above-described kneading apparatuses. If the kneading temperature is less than 80° C. and the kneading period of time is less than five minutes, the mixture is insufficiently plasticized and kneaded. If the kneading temperature is more than 90° C. and the kneading period of time is more than six minutes, there is a fear that the crosslinking agent (3) is decomposed.

The cleaning blade 20 of the present invention is formed by molding the thermosetting elastomer composition obtained by carrying out the above-described method. It is preferable to mold and process the thermosetting elastomer composition into the rectangular cleaning blade 20 having a thickness of 1 to 3 mm, a width of 10 to 40 mm, and a length of 200 to 500 mm.

The molding method is not specifically limited but a known method such as the injection molding or the compression molding can be used.

More specifically, press vulcanization is performed at 160° C. to 170° C. for 20 to 40 minutes, with the thermosetting elastomer composition set in a die. If the vulcanizing temperature is less than 160° C. and the vulcanizing period of time is less than 20 minutes, the thermosetting elastomer composition is not sufficiently vulcanized. If the vulcanizing temperature is more than 170° C. and the vulcanizing period of time is more than 40 minutes, there is a fear that the rubber component is decomposed.

Figure 2:
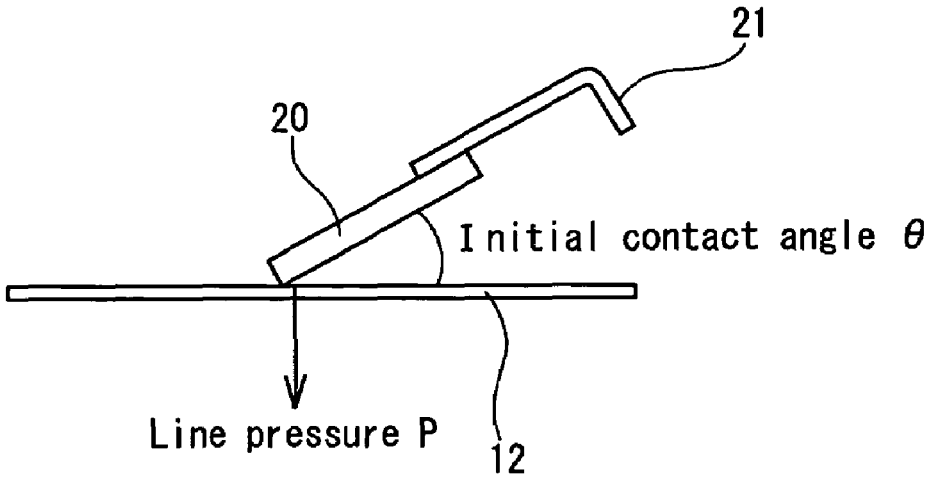
FIG. 2 is an explanatory view for explaining an initial contact angle θ of the cleaning blade of the present invention for use in the image-forming apparatus to a photoreceptor and a line pressure P of the cleaning blade to be applied to the photoreceptor.

As shown in FIG. 2, the cleaning blade obtained in the above-described method is brought into contact with the surface of a photoreceptor 12 at an initial contact angle θ of 20° to 40° to the photoreceptor 12. A line pressure P of the cleaning blade 20 to be applied to the photoreceptor 12 is set to 0.2 N/cm to 1.4 N/cm. Thereby it is possible to clean small-diameter spherical polymerized toner having a volumetric mean diameter of 5 μm to 10 μm and a sphericity of 0.90 to 0.99 without the cleaning blade generating the noise-making phenomenon and the reversal phenomenon at a cleaning time.

EXAMPLES

Examples of the present invention and comparison examples are described below.

Examples 1 Through 4 and Comparison Examples 1 Through 4

After the mixing amount of each of the rubber component (1) and the filler (2) shown in table 1 was measured, the rubber component (1) and the filler (2*a*, 2*b*) were supplied to a rubber kneading apparatus such as a twin screw extruder, an open roll or a Banbury mixer. Thereafter they were kneaded for five to six minutes while they were being heated to 80° C. to 120° C.

The obtained mixture and the crosslinking agent (3) were supplied to the rubber kneading apparatus such as the open roll, the Banbury mixer or the kneader. The mixing amount of the crosslinking agent (3) is shown in table 1. Thereafter they were kneaded for five to six minutes while they were being heated to 80° C. to 90° C.

After the obtained rubber composition was set in a die, it was press-vulcanized at 160° C. to 170° C. for 20 to 40 minutes to obtain a sheet having a thickness of 2 mm.

After a cleaning blade having a width of 27 mm and a length of 320 mm was cut out of the obtained sheet having the thickness of 2 mm, the cleaning blade was bonded to a supporting member made of chrome free SECC with hot-melt made of diamond. The central portion of the sheet was cut to obtain a cleaning member.

TABLE 1

| | | Example | | | | Comparison example | | | |
|---|---|---|---|---|---|---|---|---|---|
| | | 1 | 2 | 3 | 4 | 1 | 2 | 3 | 4 |
| Rubber component (1) | NBR | 100 | 100 | 100 | 100 | | | 100 | 100 |
| (rubber a) | Urethane rubber | | | | | 100 | 100 | | |
| Filler (2) | Carbon black | 15 | 15 | 50 | 50 | | | | |
| | Magnesium oxide | 10 | 10 | | | | | | |
| | Methacrylic acid | 10 | 10 | | | | | | |
| | Zinc oxide | | | 5 | 5 | | | | |
| | Stearic acid | | | 5 | 5 | | | | |
| | Vulcanization accelerator A | | | 1.5 | 1.5 | | | 1.5 | 1.5 |
| | Vulcanization accelerator B | | | 0.5 | 0.5 | | | 0.5 | 0.5 |
| Crosslinking agent (3) | Sulfur | | | 1.5 | 1.5 | | | 1.5 | 1.5 |
| | Organic peroxide | 3 | 3 | | | | | | |
| Particle diameter of polymerized toner(μm) | | 5 | 5 | 5 | 5 | 8 | 8 | | |
| Sphericity of polymerized toner | | 0.95 | 0.95 | 0.95 | 0.95 | 0.95 | 0.95 | 0.95 | 0.95 |
| Initial contact angle(°) | | 20 | 40 | 20 | 40 | 20 | 40 | 8 | 52 |
| Line pressure(N/cm) | | 0.71 | 1.22 | 0.55 | 1.43 | 0.09 | 1.6 | 0.04 | 1.6 |
| Noise-making phenomenon | | ○ | ○ | ○ | ○ | Δ | X | Δ | X |
| Reversal phenomenon | | ○ | ○ | ○ | ○ | Δ | X | Δ | X |
| Cleaning performance | | ○ | ◎ | ○ | ◎ | X | X | X | X |

The following products were used for the components shown in table 1:

NBR (acrylonitrile-butadiene rubber): "N232S" produced by JSR Corporation. (bound acrylonitrile amount: 35%)

Urethane rubber: commercially available urethane rubber (hardness: 75 A)

Carbon black: "SEAST ISAF" produced by Tokai Carbon Co.,Ltd.

Magnesium oxide: "150ST" produced by Kyowa Chemical Industry Co.,Ltd.

Methacrylic acid: "MAA (commercial name)" produced by Mitsubishi Rayon Co.,Ltd.

Zinc oxide: "Two kinds of zinc oxide (commercial name)" produced by Mitsui Mining and Smelting Co.,Ltd.

Stearic acid: "Tsubaki" produced by NOF Corporation.

Vulcanization accelerator A (dibenzothiazyl disulfide): "Knockseller DM" produced by Ouchi Shinko Chemical Industrial Co.,Ltd.

Vulcanization accelerator B (tetramethylthiuram monosulfide): "Knockseller TS" produced by Ouchi Shinko Chemical Industrial Co.,Ltd.

Sulfur: Powdery sulfur produced by Tsurumi Chemical Co., Ltd.

Organic peroxide (dicumyl peroxide): "Percumyl D" produced by NOF Corporation.

The noise-making phenomenon, reversal phenomenon, and the cleaning performance of the cleaning blade were evaluated by a method described below.

Figure 3:
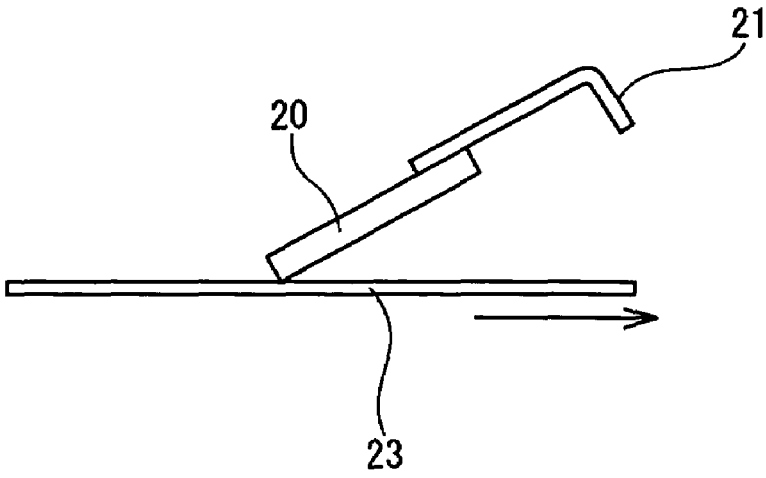
FIG. 3 explains a method of examining cleaning performance of cleaning blades of examples of the present invention.

As shown in FIG. 3, small-diameter spherical polymerized toner (commercially available toner taken out from commercially available printer produced by Canon) having a diameter and a sphericity shown in table 1 was attached to a horizontally placed glass plate 23 to which OPC (Organic Photo Conductor produced by the present applicant) was applied.

The OPC-applied glass plate 23 was moved at 200 mm/second, with the cleaning blade 20 of each of the examples and the comparison examples in contact with the OPC-applied glass plate 23 at an initial contact angle of 20 or 40 degrees to the OPC-applied glass plate 23 to observe whether the noise-making phenomenon and the reversal phenomenon were generated and toner-scraped states.

Regarding the noise-making phenomenon, specimens which did not make a noise were marked by ○. Specimens which made a noise to a slight extent were marked by Δ. Specimens which made a big noise were marked by X. Regarding the reversal phenomenon, specimens which did not present the reversal phenomenon were marked by ○. Specimens which presented the reversal phenomenon to a slight extent were marked by Δ. specimens which presented the reversal phenomenon were marked by X.

Regarding the cleaning performance, specimens which completely scraped off all toner from the glass plate 23 were marked by ◎. Specimens which scraped off toner therefrom were marked by ○. Specimens which left a small amount of toner thereon were marked by Δ. Specimens which left toner thereon to such a high extent that toner could be observed visually were marked by X. The test was conducted at a normal temperature of 23° C. and a relative humidity of 55%.

As apparent from table 1, the occurrence of the noise-making phenomenon and the reversal phenomenon were observed in the cleaning blade of the comparison example 1 consisting of the urethane rubber and was unfavorable in the performance of cleaning the spherical polymerized toner having a small diameter, although the cleaning blade of the comparison example 1 had a much smaller line pressure than those of the examples 1 through 4. The noise-making phenomenon and the reversal phenomenon occurred to a high extent in the cleaning blade of the comparison example 2 consisting of the urethane rubber, although the cleaning blade of the comparison example 2 had a line pressure of 1.6 N/cm which was a little larger than that of the cleaning blade of the example 4. Further the cleaning blade of the comparison example 2 was unfavorable in the performance of cleaning the spherical polymerized toner having a small diameter.

The noise-making phenomenon and the reversal phenomenon were not observed in the cleaning blades of the examples 1 through 4, each containing the acrylonitrile-butadiene rubber, in which the initial contact angles were set to 10° to 50°, and the line pressures were set to 0.1 N/cm to 1.5 N/cm. Further the cleaning blades of the examples 1 through 4 were favorable in the performance of cleaning the spherical polymerized toner having a small diameter.

In the cleaning blades of the comparison examples 3 and 4 each containing the NBR but not the methacrylic acid or the zinc oxide, the initial contact angles were set to 8° smaller than 10°and 52° exceeding 50° respectively, and the line pressures were set to 0.04 N/cm smaller than 0.1 N/cm and 1.6 N/cm larger than 1.5 N/cm respectively. The cleaning blade of the comparison examples 3 and 4 were evaluated as X or Δ in the noise-making phenomenon, the reversal phenomenon, and the cleaning performance.

What is claimed is:

1. A cleaning blade, for cleaning toner on a surface of a photoreceptor of an image-forming apparatus, which is formed by molding into a thin plate a thermosetting elastomer composition containing: a rubber component (1) consisting of a moderate high-nitrile acrylonitrile-butadiene rubber having a bound acrylonitrile amount of 31% to 36%, a hydrogenated acrylonitrile-butadiene rubber having a residual double bond content of not more than 10%, or a mixture of said rubbers, 0.1 parts by mass to 80 parts by mass of a filler (2) per 100 parts by mass of said rubber component (1), and 0.1 parts by mass to 30 parts by mass of a crosslinking agent (3) per 100 parts by mass of said rubber component (1), wherein said filler is either a combination of methacrylic acid, carbon black and magnesium oxide or a combination of zinc oxide, carbon black and stearic acid; wherein an initial contact angle of said cleaning blade to said photoreceptor is set to 10° to 50°; and wherein a line pressure of said cleaning blade to be applied to said photoreceptor is set to 0.1 N/cm to 1.5 N/cm.

2. The cleaning blade according to claim 1, wherein said filler (2) includes at least one substance selected from the group consisting of a co-crosslinking agent, a vulcanization accelerator, a vulcanization-accelerating assistant, an age resistor, a softener for rubber, and a reinforcing agent.

3. The cleaning blade according to claim 2, wherein said crosslinking agent (3) includes sulfur, an organic sulfur-containing compound, an organic peroxide, a heat-resistant crosslinking agent, and a resin crosslinking agent.

4. The cleaning blade according to claim 1, wherein said filler (2) is present in an amount of 20 parts by mass to 70 parts by mass, and wherein the crosslinking agent (3) is present in amount of 1 part by mass to 20 parts by mass, per 100 parts by mass of said rubber component (1).

* * * * *